United States Patent [19]

Liljekvist

[11] 4,441,565

[45] Apr. 10, 1984

[54] GUIDING DEVICE FOR PERCUSSION DRILLS

[75] Inventor: Bernt S. Liljekvist, Storvik, Sweden

[73] Assignee: Santrade Ltd., Lucerne, Switzerland

[21] Appl. No.: 353,946

[22] Filed: Mar. 2, 1982

[30] Foreign Application Priority Data

Mar. 19, 1981 [SE] Sweden ..... 8101749

[51] Int. Cl.[3] ..... E21B 17/10

[52] U.S. Cl. ..... 175/325; 175/408; 308/4 A

[58] Field of Search ..... 175/325, 408, 305, 293; 308/4 A; 166/241

[56] References Cited

U.S. PATENT DOCUMENTS

| | | | |
|---|---|---|---|
| Re. 23,860 | 8/1954 | Burris | 175/295 |
| 2,563,038 | 8/1951 | Irwin | 166/175 |
| 2,835,473 | 5/1958 | Burris | 175/295 |
| 2,956,783 | 10/1960 | Landstedt | 175/325 |
| 3,277,972 | 10/1966 | Lagerstrom | 175/325 |
| 3,313,364 | 4/1967 | Binkley | 175/325 |
| 4,220,213 | 9/1980 | Hamilton | 175/325 |

*Primary Examiner*—Ernest R. Purser
*Assistant Examiner*—Thuy M. Bui
*Attorney, Agent, or Firm*—Burns, Doane, Swecker & Mathis

[57] ABSTRACT

A guiding means in rock drilling for guiding a percussion drill string (10) comprises a guide sleeve (17). For purposes of ensuring free rotation between the drill string (10) and the guide sleeve (17) the latter is bound by shape to the drill string at its one end during drilling as well as during withdrawal of the drill string (10).

9 Claims, 3 Drawing Figures

GUIDING DEVICE FOR PERCUSSION DRILLS

BACKGROUND AND SUMMARY OF THE INVENTION

This invention relates to guiding means in rock drilling for guiding a percussion drill string comprising a guide sleeve which is rotatable relative to the drill string and adapted to follow axially therewith during drilling. Specifically, the invention relates to a guide sleeve and a drill rod adapted to be used in the guiding means.

In rock drilling by means of a percussion drill string comprising a plurality of consecutive drill rods the drill bit has normally a larger diameter than the coupling sleeves, which interconnect the drill rods, thereby allowing the cuttings to be flushed out of the drill hole and the drill rods to be rotated. Due to this fact there is a risk that the drill string is bent with the result that the pursued straightness of the hole is not achieved. For purposes of improving this straightness it has been proposed to use particular guide sleeves, which have a larger diameter than conventional coupling sleeves and which are provided with longitudinally extending ridges for allowing by-pass of the cuttings. A guide sleeve of this type is shown in U.S. Pat. No. 3,136,377. Those prior art guide sleeves are intended to rotate together with the drill string in normal operation. However, in case any hindrances to the rotation of the guide sleeve should occur during drilling, the drilling operation can still be continued, since the drill string may rotate independent of the guide sleeve. In practice, however, it has been found that the ridges of the guide sleeve do cause such large friction against the wall of the drill hole that the rotation of the drill string is made more difficult, and large wear is caused on the guide sleeve at its end faces.

U.S. Pat. No. 2,072,320 suggests to use roller bearings between the guide sleeve and the drill string in a drill string for rotary drilling. This is an expensive solution which furthermore is unsuitable in percussive drilling.

The object of the invention is to provide improved guiding means for guiding percussion drill strings, which does not have the above-mentioned disadvantages.

Another object of the invention is to design the guide sleeve and a drill rod carrying same in such a way that a simplified assembling of the guide sleeve is obtained.

The above and other purposes are attained by giving the invention the characterizing features state in the appending claims.

BRIEF DESCRIPTION OF THE DRAWING

The invention is described in detail in the following with reference to the accompanying drawings in which one embodiment is shown by way of example. It is to be understood that this embodiment is only illustrative of the invention and that various modifications thereof may be made within the scope of the claims.

In the drawings.

DESCRIPTION OF PREFERRED EMBODIMENTS OF THE INVENTION

Figure 1:
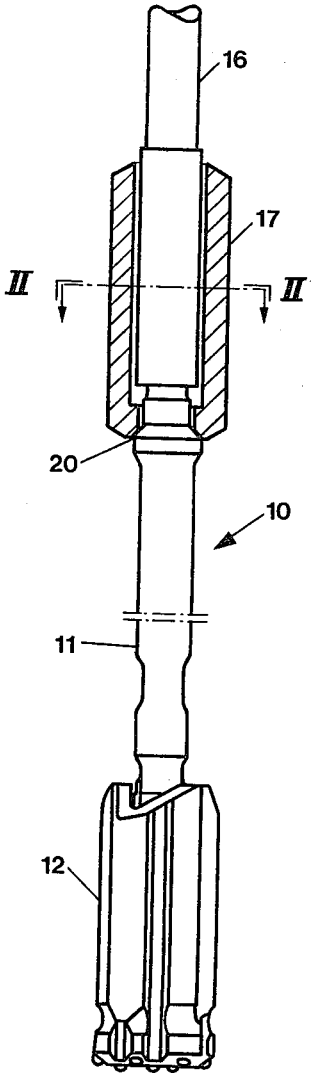
FIG. 1 shows the front portion of a percussion drill string provided with guiding means according to the invention.
Figure 2:
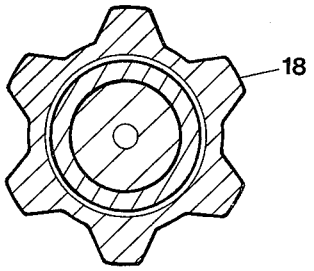
FIG. 2 is a section taken on the line II—II in FIG. 1.

In FIG. 1 the percussion drill string generally denoted by 10 comprises a forward drill rod 11, which carries a rock drill bit 12. Rearwardly, the drill rod 11 is provided with a threaded portion 13, which in conventional manner is connected to a threaded portion 15 on a drill rod 16 by means of a coupling sleeve 14.

A guide sleeve 17 is arranged outwardly of the coupling sleeve 14 coaxially therewith to encompass same. The guide sleeve 17 is provided with ridges 18 between which the cuttings will flow during drilling. The outer diameter of the guide sleeve 17 when measured over the ridges 18 coincides substantially with the diameter of the drill hole. Due to the friction between the ridges 18 and the wall of the drill hole the guide sleeve 17 is thus normally locked against rotation.

Figure 3:
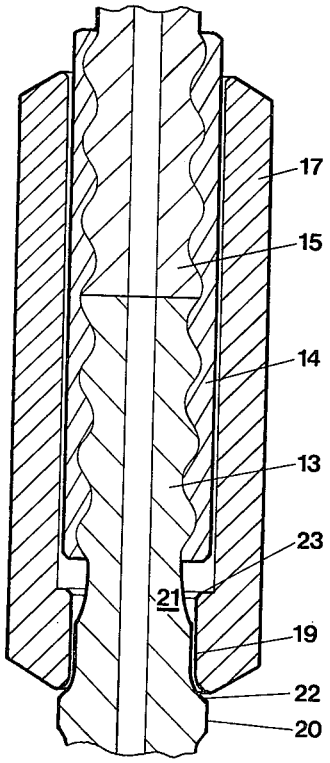
FIG. 3 shows the guiding means in FIG. 1 on an enlarged scale.

According to the invention the guide sleeve 17 is provided with a radially inwards projecting portion 19, which extends radially inwardly of the remaining portion of the guide sleeve. The portion 19 is adapted to engage between longitudinally spaced surfaces defined by the coupling sleeve 14 and an annular shoulder 20 on the drill rod 11. In the preferred embodiment the portion 19 is located at the forward end of the guide sleeve when seen in the drilling direction. Due to the above design there is created a shape-bound connection between the guide sleeve 17 and the drill string 10, thereby ensuring that the guide sleeve 17 axially follows the drill string during drilling. As to the remaining portion of the guide sleeve this portion is axially freely movable relative to the drill string 10 due to a radial play, which is provided between the coupling sleeve 14 and the guide sleeve 17. Further, there is a radial play between the portion 19 on the guide sleeve 17 and an intermediate portion 21 on the drill string between the shoulder 20 and the coupling sleeve 14. As may be seen in FIG. 3 there is an axial play between on the one hand the portion 19 and on the other the shoulder 20 and the coupling sleeve 14. During drilling, thus, the drill string rotates freely within the guide sleeve while the latter prevents radial bending of the drill string. At the outer end of the guide sleeve the inwards projecting portion 19 is bevelled or rounded at its inner edge, thereby providing a shape which is suited to an annular surface 22 on the shoulder 20. The surface 22 forms the envelope surface of a truncated cone. The surface 22 may be arbitrarily designed, such as straight, convex or concave. At its opposite end the portion 19 is provided with a radially extending end face 23. During drilling the guide sleeve 17 is forced downwards by the impacts of the coupling sleeve 14 against the end face 23.

According to the invention there is provided a simplified assembling of the guide sleeve 17. During assembling the guide sleeve is first moved to abutment against the shoulder 20, whereupon the guide sleeve is secured axially by screwing the coupling sleeve 14 on the drill rod 11.

Advantageously, the invention may be applied in a system illustrated in FIG. 1, which comprises an axially extended drill bit 12, i.e. a drill bit having an improved guiding capacity, a drill rod 11 which is shorter than the other drill rods in the drill string, and the guide sleeve 17. The extended drill bit 12 improves the guiding during the collaring, i.e. the starting of a new hole and first penetrating into the rock, and the short drill rod 11 counteracts lateral bending of the drill string between the drill bit 12 and the guide sleeve 17.

Instead of extending rearwards from the portion 19 outwardly of the coupling sleeve 14, it is believed that the main portion of the guide sleeve 17 could extend forwards from the portion 19 with a slight radial play relative to the drill rod 11. Further, it is believed that the portion 19 might be axially locked between the rear end face of the drill bit 12 and a shoulder on the drill rod 11. In such case, the main portion of the guide sleeve extends rearwards from the portion 19 with a slight radial play relative to the drill rod 11.

In the illustrated embodiment the guide sleeve 17 has substantially the same axial extent rearwards as the coupling sleeve 14. For purposes of making possible mechanized disconnection of the coupling sleeve, when needed, it may be suitable to make the guide sleeve shorter, for instance in the order of half the length of the coupling sleeve.

The drill bit 12 is in the illustrated embodiment designed so as to have a guiding function. The same guiding effect can be achieved if a standard drill bit is used together with a guide sleeve according to the invention. In this case the guide sleeve is turned with respect to the position shown in FIG. 1, so that its inwards projecting portion 19 engages between the rear end face of the drill bit and a collar on the drill rod provided in association with the drill bit. The portion of the guide sleeve projecting forwards from the portion 19 is then arranged outwardly of the rear narrower portion of the drill bit and extends preferably to vicinity of the head portion of the drill bit.

The drill bit 12 is rearwardly provided with cutting means in order to facilitate withdrawal of the drill string. Analogously, also the guide sleeve may be provided with cutting means at its rear end when it is intended to be mounted on the drill bit. In this case, suitably, a coupling of claw-type may then be provided between the guide sleeve and the drill bit, said coupling allowing relative rotation between the guide sleeve and the drill bit during drilling but securing the guide sleeve non-rotatably to the drill bit during withdrawal of the drill string.

A drill rod according to the invention may also be used together with a guide sleeve having smaller inner diameter than the outer diameter of the coupling sleeve. Such a guide sleeve is arranged between the forward end face of the coupling sleeve and the annular shoulder, in which case the axial distance between the rear threaded portion of the drill rod and the shoulder, thus, is larger than the distance shown in FIGS. 1 and 3.

What is claimed is:

1. In combination a percussion drill string for rock drilling and a guide sleeve mounted coaxially upon said drill string for rotation relative thereto about a longitudinal axis of said drill string, said guide sleeve including outer surface means for engaging a wall of a bore hole to guide said drill string during drilling, said drill string including longitudinally spaced, generally radially disposed surfaces defining a longitudinal space therebetween, said guide sleeve including a radially inwardly projecting portion extending into said space such that said surfaces and projecting portion being configured to longitudinally secure said guide sleeve to said drill string and permit relative rotation between said guide sleeve and said drill string about said longitudinal axis when said guide sleeve is in its lowermost position on said drill string.

2. A combination according to claim 1, wherein said radially inwardly projecting portion is disposed at a forward end of said guide sleeve in the direction of cutting.

3. A combination according to claim 1, wherein one of said longitudinally spaced surfaces is defined by a part of the drill string which is removable from another part thereof which defines the other of said longitudinally spaced surfaces.

4. In combination a percussion drill string for rock drilling and a guide sleeve mounted coaxially upon said drill string for rotation relative thereto about a longitudinal axis of said drill string, said guide sleeve including outer surface means for engaging a wall of a bore hole to guide said drill string during drilling, said drill string including longitudinally spaced, generally radially disposed surfaces defining a longitudinal space therebetween, said guide sleeve including a radially inwardly projecting portion extending into said space such that said surfaces and projecting portion longitudinally secure said guide sleeve to said drill string while permitting relative rotation between said guide sleeve and said drill string about said longitudinal axis, said drill string comprising first and second adjoining drill rods having external threads at their adjoining ends, and a coupling sleeve having internal threads joined to the external threads of said first and second drill rods to interconnect said drill rods, one of said longitudinally spaced surfaces being defined by a radially outwardly extending shoulder of said first drill rod, the other of said longitudinally spaced surfaces being defined by said coupling sleeve, said guide sleeve disposed in encompassing relationship with said coupling sleeve.

5. A combination according to claim 4, wherein the portion of said drill string disposed between said longitudinally spaced surfaces forms a radial gap with said radially inwardly projecting portion to permit free relative rotation between said guide sleeve and said drill string.

6. A guide sleeve adapted to be rotatably mounted coaxially upon a percussion drill string which includes longitudinally spaced generally radially disposed surfaces forming a longitudinal space therebetween, said guide sleeve including outer surface means for engaging a wall of a bore hole to guide the drill string during drilling and a radially inwardly projecting portion in the form of a single annular projection projecting radially inwardly of the remainder of said guide sleeve and dimensioned to extend into said space such that said surfaces and said projecting portion longitudinally secure said guide sleeve to said drill string while permitting relative rotation therebetween when said guide sleeve is in its lowermost position on the string.

7. A guide sleeve according to claim 6, wherein said projecting portion includes forward and rearward ends, said forward end being generally beveled, said rear end being radially disposed.

8. In combination a percussion drill string for rock drilling and a guide sleeve mounted coaxially upon said drill string for rotation relative thereto about a longitudinal axis of said drill string, said guide sleeve including outer surface means for engaging a wall of a bore hole to guide said drill string during drilling, said drill string including longitudinally spaced, generally radially disposed surfaces defining a longitudinal space therebetween, said guide sleeve including a radially inwardly projecting portion extending into said space such that said surfaces and projecting portion longitudinally secure said guide sleeve to said drill string while permitting relative rotation between said guide sleeve and said drill string about said longitudinal axis, said drill string including a drill rod and a drill bit carried at a forward end of said drill rod, one of said longitudinally spaced surfaces being defined by said drill rod and the other longitudinally spaced surface being defined by said drill bit.

9. In combination a percussion drill string for rock drilling and a guide sleeve mounted coaxially upon said drill string for rotation relative thereto about a longitudinal axis of said drill string, said guide sleeve including outer surface means for engaging a wall of a bore hole to guide said drill string during drilling, said drill string including longitudinally spaced, generally radially disposed surfaces defining a longitudinal space therebetween, said guide sleeve including a radially inwardly projecting portion extending into said space such that said surfaces and projecting portion longitudinally secure said guide sleeve to said drill string while permitting relative rotation between said guide sleeve and said drill string about said longitudinal axis, said drill string comprising first and second adjoining drill rods having external threads at their adjoining ends, and a coupling sleeve having internal threads joined to the external threads of said first and second drill rods to interconnect said drill rods, one of said longitudinally spaced surfaces being defined by a radially outwardly extending shoulder of said first drill rod, the other of said longitudinally spaced surfaces being defined by said coupling sleeve.

* * * * *